US005546470A

United States Patent [19]

Geisenberger et al.

[11] Patent Number: 5,546,470

[45] Date of Patent: Aug. 13, 1996

[54] LOUDSPEAKER

[75] Inventors: Stefan Geisenberger, Straubing; Manfred Aigner, Schwarzach, both of Germany

[73] Assignee: Nokia Technology GmbH, Pforzheim, Germany

[21] Appl. No.: 447,558

[22] Filed: May 23, 1995

[30] Foreign Application Priority Data

Jun. 1, 1994 [DE] Germany ..... 44 19 312.2

[51] Int. Cl.[6] ..... H04R 25/00

[52] U.S. Cl. ..... 381/197; 381/194

[58] Field of Search ..... 381/192, 194, 381/197, 199, 201, 200; 335/222

[56] References Cited

FOREIGN PATENT DOCUMENTS 9109452 11/1991 Germany .
3302592 3/1992 Germany .
3036876 9/1993 Germany .
4241212 6/1994 Germany ..... 381/199
4255197 9/1992 Japan ..... 381/199
1760647 9/1992 U.S.S.R. .

*Primary Examiner*—Curtis Kuntz
*Assistant Examiner*—Huyen D. Le
*Attorney, Agent, or Firm*—Ware, Fressola, Van Der Sluys & Adolphson

[57] ABSTRACT

According to the state of the art, high-temperature resistant centering of loudspeakers is configured so that a rod (17) that is connected to the pole body (14) serves as a guide for a bushing (19) connected to the voice coil support (11). However, the narrow space between the rod (17) and the bushing (19) leads to friction between the rod (17) and the bushing (19) during excursion movements of the voice coil support (11), which retards the free movement of the voice coil support (11). The invention therefore has the task of providing high-temperature resistant centering for loudspeakers, in which any touching of rod (17) and bushing (19) is eliminated. The invention makes the rod (17) and the bushing (19) from magnetic material, and magnetizes this material radially to the loudspeaker axis (16). If the facing magnetic areas of rod (17) and bushing (19) have the same polarity, no-contact centering of the bushing (19) over the rod (17) is achieved by the mutual rejection.

7 Claims, 3 Drawing Sheets

LOUDSPEAKER

TECHNICAL FIELD

The invention concerns a centering device for loudspeakers.

BACKGROUND OF THE INVENTION

In the state of the art, centering diaphragms for loudspeakers are generally built so that one edge of a disk-shaped sleeve, which is wavy when viewed from the side, is connected to the loudspeaker frame, and the other edge to the voice coil support or the loudspeaker diaphragm. Such sleeves are usually made of natural fibers or plastic, and are also impregnated, for example with synthetic resin. The connection of the sleeve edges to the usual components of the loudspeaker is mostly achieved with an adhesive.

Although such devices can be used up to about 100 degrees Celsius without any problems, considerable problems occur when such loudspeakers are used above the cited temperature range, since the adhesive bonds and/or the impregnations are then no longer stable.

A centering device for loudspeakers is known from document U.S. Ser. No. 08/163,662 (now abandoned), which claims priority from German patent DE 42 41 212, which also serves as the starting point for this patent application, and makes the use of sleeve-shaped centering diaphragms superfluous in addition to remaining stable at very high operating temperatures.

There, a rod is placed on the pole body of the magnet system and is centered with the loudspeaker axis. A bushing is placed over this rod, which surrounds the outer casing of the rod at a small distance, and can slide on the rod in the lengthwise direction of the loudspeaker axis. The outer casing of the bushing is connected to the voice coil support. A spiral spring is stretched between the lower edge of the bushing and the pole body, and also between the upper edge of the bushing and a dish connected to the upper end of the rod, which, in the idle position of the system, locates the voice coil connected to the voice coil support in the plane of the pole plate. The distance between the inner case of the bushing and the outer case of the "strands" must be small, in order to properly center the rod/bushing assembly. However, this proximity of both parts can lead to touching of the respective casing surfaces of bushing and rod during the excursions of the voice coil support. Such touching impedes the free excursion of the voice coil support and leads to distortion of the sound reproduced by the loudspeaker. In this connection it is especially disadvantageous when dirt particles accumulate in the gap between rod and bushing, since these particles also increase the friction between bushing and rod.

It is therefore the task of the invention to provide sleeveless centering for loudspeakers, which eliminates any touching of rod and bushing.

SUMMARY OF THE INVENTION

If the rod and the bushing are at least partially made of magnetic material, and the magnetic material areas are magnetized radially with respect to the loudspeaker axis, and the radially magnetized, adjacently facing areas of bushing and rod have the same polarity, then the distance between the inner case of the bushing and the outer case of the rod can be enlarged without losing the centering effect. It is rather ensured by the mutual rejection of the facing poles of bushing and rod.

It is particularly simple to construct the centering device, if the bushing is made of a magnetizable ring and the rod of a magnetizable piece of bar material. This is so because in that case the independent construction of rod and bushing by joining magnet segments to a base material can be omitted.

The bushing can also be used to connect the voice coil support and the loudspeaker diaphragm. For example, if the bushing is placed inside of the voice coil support in the connection area of voice coil support and loudspeaker diaphragm, and a clamping ring is placed around the outer casing of the loudspeaker diaphragm in the connection area, which presses the voice coil support and loudspeaker diaphragm areas against the bushing, then an adhesive connection of the cited parts can either be entirely, or at least partially, omitted.

It should already be pointed out here that this pressure connection of voice coil support and loudspeaker diaphragm can also be used independently. For example, the clamping ring can press the loudspeaker diaphragm against the voice coil support. If the wall thickness of the voice coil support is too thin to support such a pressure connection, a reinforcement ring can be formed at the inner casing of the voice coil support, without attributing any centering characteristics to this reinforcement ring.

The production of the press fit connection is particularly simple if the clamping ring has a lower coefficient of thermal expansion than the bushing or the reinforcement ring. In that case the pressure effect of the clamping ring on the bushing or the reinforcement ring is strengthened, so that the parts between them are pressed against each other with greater force. If the force of the clamping ring pressure on the bushing or the reinforcement ring is insufficient below the operating temperature of the system, the voice coil support and the loudspeaker diaphragm, as well as the bushing or the reinforcement ring and the clamping ring, could be cemented by an adhesive. In that case the adhesive would only have the task of securing the connection below the operating temperature. As the temperature rises, the connection is then taken over by the clamping ring and the bushing, or the reinforcement ring. When the system is turned off, the adhesive force again takes over the bonding function between the above mentioned parts. If the connection between the voice coil support and the loudspeaker diaphragm is taken over by the clamping ring and the bushing, without attributing any centering effect to the bushing, such a clamping arrangement can also be used to connect the sleeve-shaped centering diaphragm to the voice coil support or the loudspeaker diaphragm.

BEST MODE FOR CARRYING OUT THE INVENTION

Figure 1:
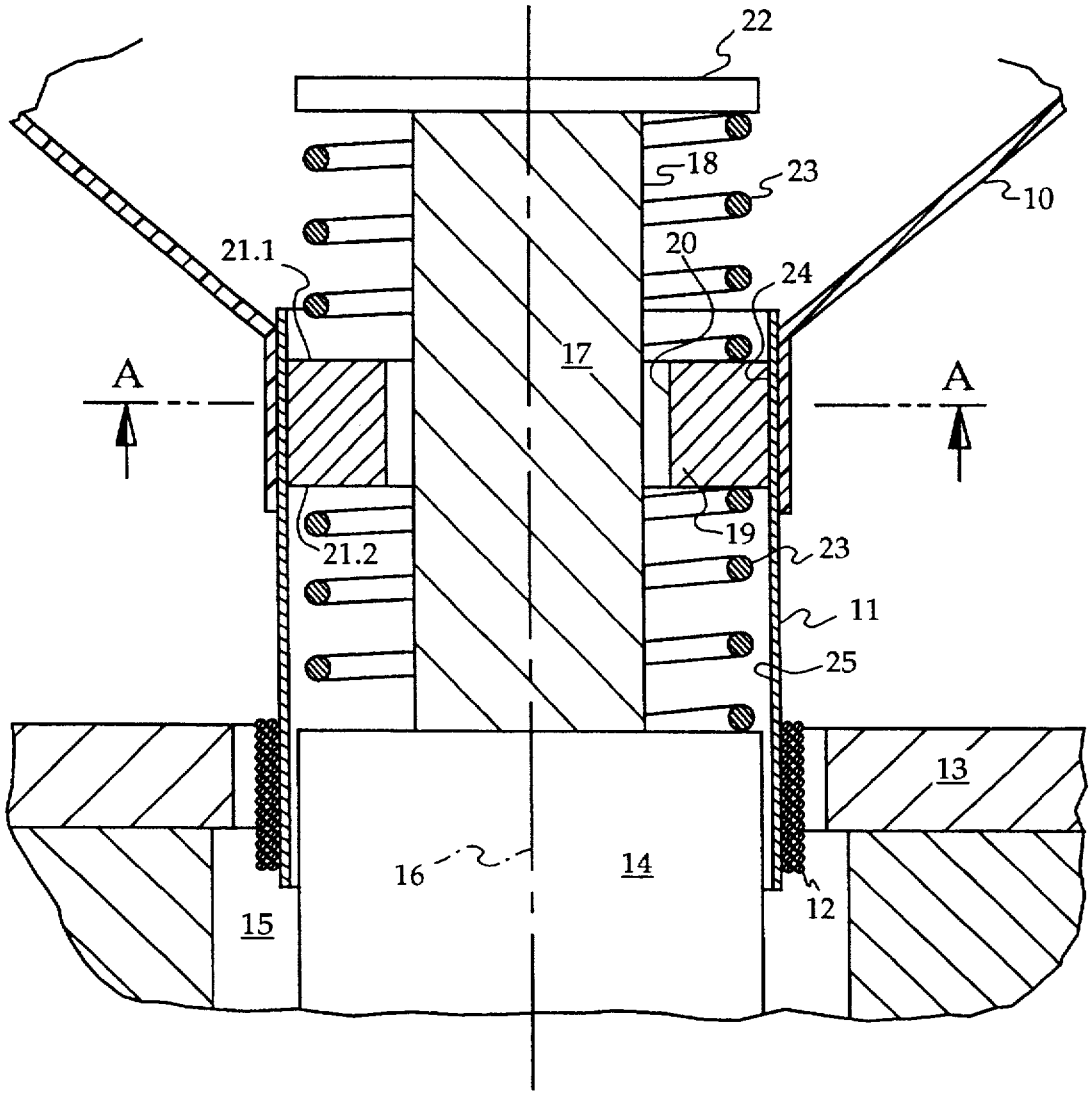
FIG. 1 is a partial cross section of a loudspeaker.

FIG. 1 represents a cut through a section of a loudspeaker.

The loudspeaker diaphragm 10 is connected to the upper end of the voice coil support 11. The lower end of the voice coil support 11 is equipped with loudspeaker diaphragm 12. The air gap 15 of the system is formed between the pole plate 13 and the pole body 14. The voice coil 12 is located in the plane of pole plate 13, because the illustration in FIG.

1 represents the idle position of the system. A rod 17 is placed on the pole body 14 and centered with respect to the loudspeaker axis 16. The outer casing 18 of rod 17 is at least partially surrounded by bushing 19 in the lengthwise direction of the loudspeaker axis. The distance between the outer casing 18 of rod 17 and the inner casing 20 of bushing 19 is the same on both sides shown. How these distance relationships are adjusted is further explained in conjunction with FIG. 2.

One spiral spring 23 each stretches between the pole body 14 and the lower edge 21.2 of bushing 19, and between the upper edge 21.1 of bushing 19 and a dish 22 connected to the upper end of rod 17. Since the outer casing 24 of bushing 19 is also connected to the inner casing 25 of voice coil support 11, the springs 23 locate the voice coil 12 in the plane of pole plate 13 when the system is in the idle position. The mentioned position of pole plate 13 and voice coil 12 can also be realized in another—not illustrated—configuration example without the use of springs 23, if the loudspeaker diaphragm 10 and the bead—not illustrated—are able to keep the voice coil 12 in the cited position with respect to the pole plate, because of their stiffness.

DE 42 41 212 describes how the above described arrangement can be used with the springs 23 to contact the voice coil 12.

Figure 2:
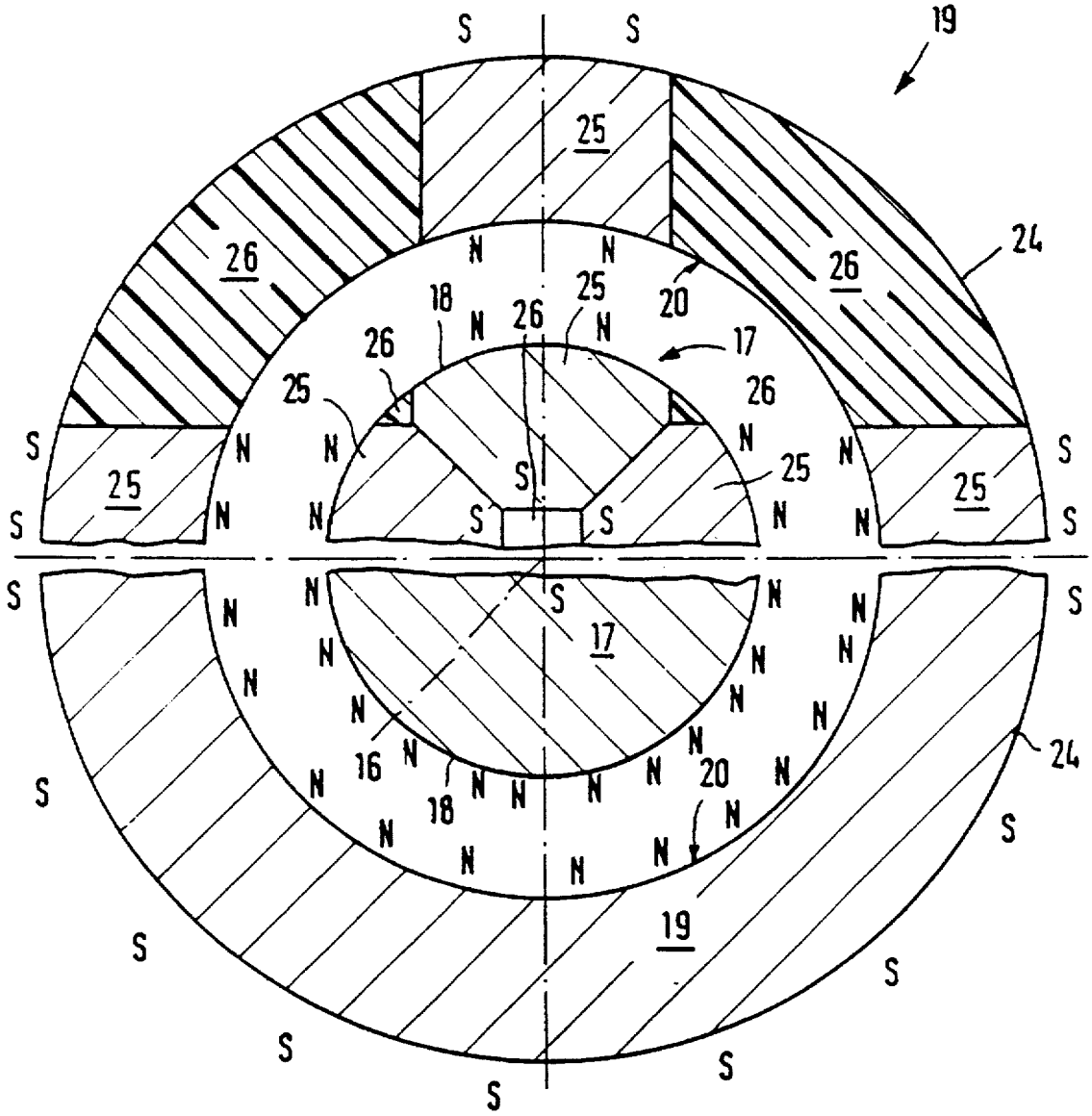
FIG. 2 is a view taken along line A—A in FIG. 1.

Under the horizontal center line, FIG. 2 depicts a rod/bushing arrangement according to FIG. 1. In this illustration, the bushing 19 and the rod 17 are made entirely of magnetic material, where the magnetization direction of both parts 17, 19 is radial to the axis of loudspeaker 16. The casing surfaces of bushing 19 and rod 17, which face each other, have the same polarization (N/N in this instance). This has the effect of bushing 19 remaining centered with respect to rod 17 under any operating conditions. Off-center placements of bushing 19 with respect to rod 17 or the loudspeaker axis, perhaps during the excursion, are immediately compensated by the mutual rejection of the aligned, facing poles (N/N) of bushing 19 and rod 17.

The upper portion of FIG. 2 only differs from the lower portion of FIG. 2 in that the bushing 19 and the rod 17 are not made entirely of magnetic material. Rather, the bushing 19 and rod 17 are constructed of magnetic segments 25, which are connected to each other by a nonmagnetic base material 26. The sketched in poles indicate that the segments 25 are magnetized radially with respect to the loudspeaker axis 16, and that the north poles (N/N) of the segments 25 of bushing 19 and rod 17 face each other. The configuration shown in the upper portion of FIG. 2 also produces the centering of bushing 19 with respect to rod 17, even though the independent construction of magnetic segments 25 in a base material 16 must be considered to be expensive.

Figure 3:
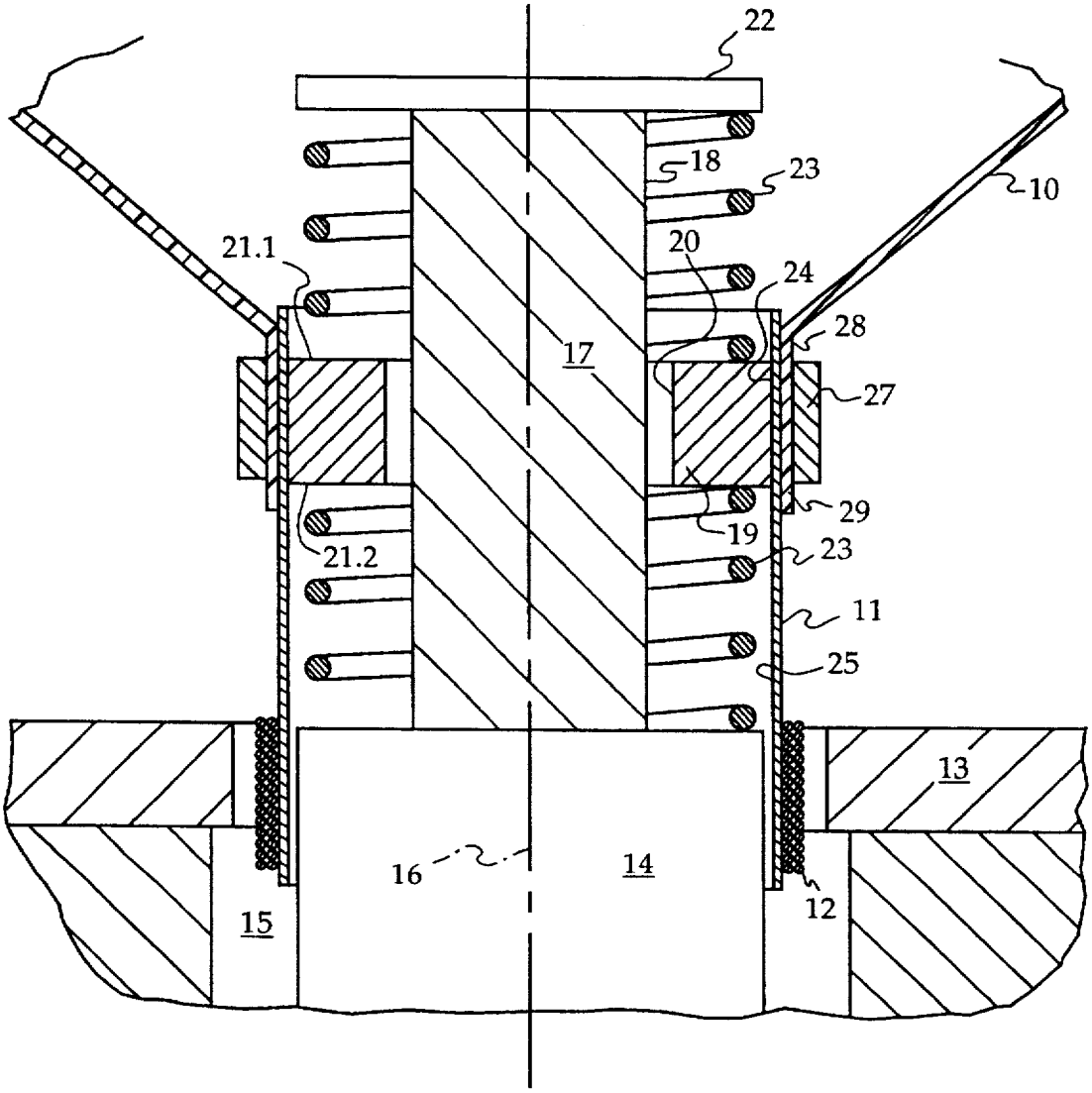
FIG. 3 is another depiction of FIG. 1.

The illustration in FIG. 3 only differs from the illustration in FIG. 1 in that the connection of bushing 19, voice coil support 11 and loudspeaker diaphragm 10 is provided by a clamping ring 27. This clamping ring 27 is placed around the outer casing 28 of the neck 29 of loudspeaker diaphragm 10. The clamping ring 27 has a lower coefficient of thermal expansion than the bushing 19, so that the clamping ring 27 presses the voice coil support 11 and the neck 29 of loudspeaker diaphragm 10 against bushing 19 when the operating temperature increases. In order to connect the parts 10, 11, 19 and 27 firmly to each other, even before the operating temperature has been reached, these parts are bonded to each other with an epoxy cement. The epoxy cement has no further function once the system's operating temperature has been reached, and clamping ring 27 actively exerts its pressure function. The adhesive effect of the epoxy cement only functions again when the system is at a lower than operating temperature.

The use of an adhesive can be entirely omitted if the clamping ring 27 is shrunk over the neck 29 of loudspeaker diaphragm 10. In that case a pressure connection is already in effect at room temperature.

What is claimed is:

1. A loudspeaker with a loudspeaker diaphragm (10), with a voice coil support (11) that is connected to the loudspeaker diaphragm (10), and with a centering device comprising a rod (17), on which a bushing (19), which is connected to the loudspeaker diaphragm (10) or to the voice coil support (11), can slide along the loudspeaker axis (16) against the effect of a spring arrangement (23), characterized in that the rod (17) and the bushing (19) are at least partially made of magnetic material, that the magnetic material is magnetized radially to the loudspeaker axis (16), and that when the bushing (19) slides over the rod (17), the facing areas of the magnetic material of the bushing (19) and the rod (17) have the same polarity.

2. A loudspeaker according to claim characterized in that the bushing (19) and the rod (17) are made entirely of magnetic material.

3. A loudspeaker according to claim 2, characterized in that the bushing (19) is located on the inner casing of the voice coil support (11) in the connection area between the voice coil support (11) and the loudspeaker diaphragm (10, 29), and that the outer casing (28) of the loudspeaker diaphragm (10, 29) is surrounded by a clamping ring (27) in the connection area between the voice coil support (11) and the loudspeaker diaphragm (10, 29).

4. A loudspeaker according to claim 3, characterized in that the clamping ring (27) has a lower coefficient of thermal expansion, at least with respect to the bushing (19).

5. A loudspeaker according to claim 4, characterized in that the bushing (19), the voice coil support (11), the loudspeaker diaphragm (10, 29) and the clamping ring (27) are cemented to each other, and that the cement is configured so as to ensure a connection between the bushing (19), the loudspeaker diaphragm (10, 29), the clamping ring (27) and the voice coil support (11) when the loudspeaker is at a temperature lower than operation temperature.

6. A loudspeaker according to claim 3, characterized in that the bushing (19), the voice coil support (11), the loudspeaker diaphragm (10, 29) and the clamping ring (27) are cemented to each other, and that the cement is configured so as to ensure a connection between the bushing (19), the loudspeaker diaphragm (10, 29), the clamping ring (27) and the voice coil support (11) when the loudspeaker is at a temperature lower than operating temperature.

7. A loudspeaker according to claim 1, characterized in that the bushing (19) is located on the inner casing of the voice coil support (11) in the connection area between the voice coil support (11) and the loudspeaker diaphragm (10, 29), and that the outer casing (28) of the loudspeaker diaphragm (10, 29) is surrounded by a clamping ring (27) in the connection area between the voice coil support (11) and the loudspeaker diaphragm (10, 29).

* * * * *

UNITED STATES PATENT AND TRADEMARK OFFICE

CERTIFICATE OF CORRECTION

PATENT NO. : 5,546,470

DATED : August 13, 1996

INVENTOR(S) : Geisenberger et al

It is certified that error appears in the above-indentified patent and that said Letters Patent is hereby corrected as shown below:

At column 4, line 25 (claim 2, line 1), after "claim", please insert --1,--.

Signed and Sealed this

Fourth Day of February, 1997

*Attest:*

Bruce Lehman

BRUCE LEHMAN

*Attesting Officer*

*Commissioner of Patents and Trademarks*